US008231308B2

(12) United States Patent
Alliot

(10) Patent No.: US 8,231,308 B2
(45) Date of Patent: Jul. 31, 2012

(54) HYBRID RISER TOWER AND METHOD OF INSTALLATION THEREOF

(75) Inventor: Vincent Marcel Ghislain Alliot, Paris (FR)

(73) Assignee: Acergy France SA

( * ) Notice: Subject to any disclaimer, the term of this patent is extended or adjusted under 35 U.S.C. 154(b) by 645 days.

(21) Appl. No.: 11/921,801

(22) PCT Filed: Jun. 16, 2006

(86) PCT No.: PCT/IB2006/002479

§ 371 (c)(1),
(2), (4) Date: May 27, 2009

(87) PCT Pub. No.: WO2006/136960

PCT Pub. Date: Dec. 28, 2006

(65) Prior Publication Data

US 2009/0297277 A1 Dec. 3, 2009

(30) Foreign Application Priority Data

Jun. 18, 2005 (GB) ..... 0512471.4

(51) Int. Cl.
*E02D 23/02* (2006.01)
*E02D 23/12* (2006.01)

(52) U.S. Cl. ..... 405/224.2; 405/205; 166/367

(58) Field of Classification Search ..... 405/195.1, 405/203, 205, 224, 224.2; 166/367
See application file for complete search history.

(56) References Cited

U.S. PATENT DOCUMENTS

| | | | | |
|---|---|---|---|---|
| 3,044,561 | A | 7/1962 | Swiger | |
| 3,191,388 | A | 6/1965 | Ludwig | |
| 4,646,840 | A * | 3/1987 | Bartholomew et al. | 166/350 |
| 6,004,074 | A * | 12/1999 | Shanks, II | 405/195.1 |
| 6,082,391 | A | 7/2000 | Thiebaud et al. | |
| 6,155,748 | A * | 12/2000 | Allen et al. | 405/195.1 |
| 6,443,244 | B1 * | 9/2002 | Collins | 175/61 |
| 6,837,311 | B1 | 1/2005 | Sele et al. | |
| 6,854,516 | B2 * | 2/2005 | Nish et al. | 166/350 |
| 6,896,062 | B2 * | 5/2005 | Davies et al. | 166/350 |
| 2005/0241832 | A1 * | 11/2005 | Jones et al. | 166/367 |
| 2007/0261856 | A1 * | 11/2007 | Deul | 166/367 |
| 2008/0213048 | A1 * | 9/2008 | Jones et al. | 405/224.2 |

FOREIGN PATENT DOCUMENTS

| | | |
|---|---|---|
| WO | WO 02/053869 | 7/2002 |
| WO | WO 03/031765 | 4/2003 |
| WO | WO 2004/033848 | 4/2004 |
| WO | WO 2004/051051 | 6/2004 |
| WO | WO 2004/051052 | 6/2004 |

* cited by examiner

*Primary Examiner* — Tara Mayo-Pinnock

(74) *Attorney, Agent, or Firm* — Levy & Grandinetti

(57) ABSTRACT

A method of installing a subsea structure, such as a hybrid riser tower, is disclosed. The riser tower includes a main portion and a buoyancy portion. When installed, the riser tower extends substantially from the seabed towards the surface with the buoyancy portion attached at a top end. The method includes taking the riser tower to an installation site in a substantially horizontal configuration with the main portion containing a first fluid and the buoyancy portion containing a second fluid, the second fluid being more dense than the first fluid. Then, tilting of the riser tower is performed such that it takes a substantially vertical configuration by allowing the first fluid in the elongate portion to interchange with the second fluid in the buoyancy portion. Also disclosed is a suitable apparatus for performing the method.

45 Claims, 4 Drawing Sheets

Fig. 1 – PRIOR ART

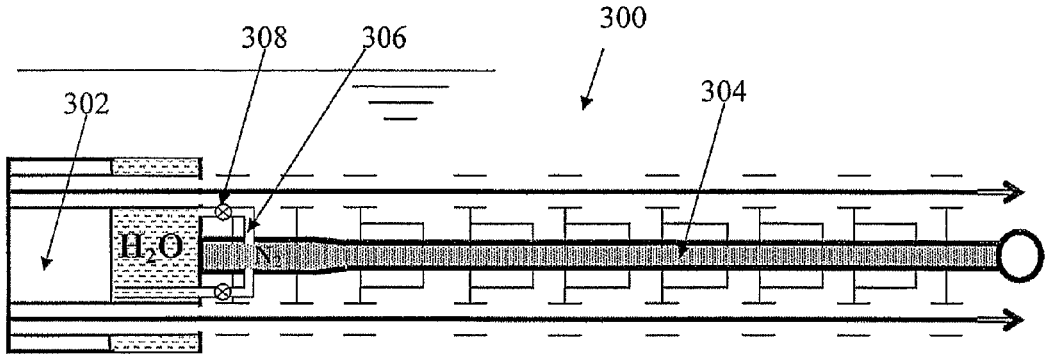
Fig. 3a
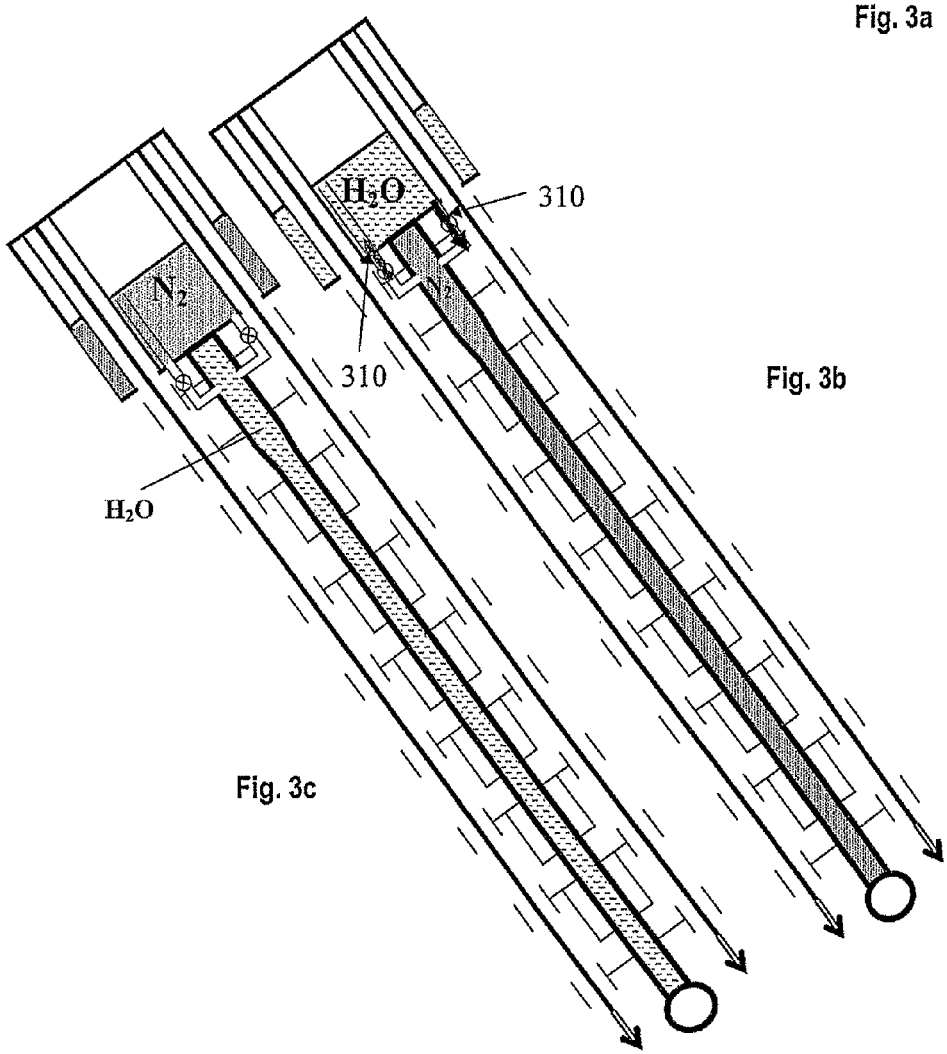
Fig. 3b
Fig. 3c

HYBRID RISER TOWER AND METHOD OF INSTALLATION THEREOF

CROSS REFERENCE TO RELATED APPLICATION

This application claims the priority of GB 0512471.4 filed on 18 Jun. 2005, the disclosure of which is incorporated herein by reference for all purposes.

The present invention relates to method and apparatus for buoyancy distribution of offshore deepwater structures, in particular, but not restricted to, buoyancy distribution along a substantially vertical submarine structure, such as a riser, a bundle of risers, or any other structural member.

The structure may form part of a so-called hybrid riser, having an upper and/or lower portions ("jumpers") made of flexible conduit and suitable for deep and ultra-deep water field development. U.S. Pat. No. 6,082,391 (Stolt/Doris) proposes a particular Hybrid Riser Tower (HRT) consisting of an empty central core, supporting a bundle of riser pipes, some used for oil production some used for water and gas injection. This type of tower has been developed and deployed for example in the Girassol field off Angola. Insulating material in the form of syntactic foam blocks surrounds the core and the pipes and separates the hot and cold fluid conduits. Further background has been published in paper "Hybrid Riser Tower: from Functional Specification to Cost per Unit Length" by J-F Saint-Marcoux and M Rochereau, DOT XIII Rio de Janeiro, 18 Oct. 2001. Updated versions of such risers have been proposed in WO 02/053869 A1. The contents of all these documents are incorporated herein by reference, as background to the present disclosure.

In particular cases, such as a hybrid riser tower (bundle of risers, fabricated onshore), buoyancy may be required for the supporting of a structure in two (or more) completely different orientations, such as a horizontal orientation (during installation) and a vertical orientation (in operation).

The HRT often has a substantial quantity of syntactic foam integrated to make it nearly neutrally buoyant in water and so to facilitate the towing operation from its fabrication site to the offshore facilities. To solve design and fabrication issues the foam is generally fitted along the core pipe and mechanically locked by means of arrestors mounted or welded onto the core pipe which stop the foam from sliding upwards. In its horizontal configuration the buoyancy of the foam and the weight of the piping nearly balance each other. After the structure is upended the buoyancy of the syntactic foam and the weight of the riser piping hanging from the top tank (the riser piping being free to slide in relation to the core pipe) creates substantial axial compression load along the core pipe. This compression load is problematic from a design and fabrication point of view since it potentially creates a zone of budding instability and high lateral loading between the core pipe and risers which imposes tight tolerances. This becomes more critical as HRTs are used in deeper waters or incorporate more risers in the HRT bundle, since the compression load is directly related to the weight of the riser hanging from the buoyancy tank. The compression load should be reduced as far as practical.

It is therefore an object of the invention to provide method and apparatus to reduce these substantial compressive forces. It is a further object of the invention to provide a HRT which requires less substantial anchoring means than at present. A yet further object of the invention provides a HRT which requires less time to empty its buoyancy tank of water ballast during installation In a first aspect of the invention there is provided a method of installing an elongate subsea structure, said elongate subsea structure comprising an elongate portion and a buoyancy portion attached at one end of said elongate portion such that, when in a vertical installed configuration, the elongate subsea structure extends substantially from the seabed towards the surface with said buoyancy portion uppermost, and wherein said method comprises taking the elongate subsea structure to an installation site in a substantially horizontal configuration with said elongate portion containing a first fluid and said buoyancy portion containing a second fluid, said second fluid being more dense than said first fluid, and tilting the elongate subsea structure such that it takes a substantially vertical configuration, while allowing said first fluid in said elongate portion to interchange with said second fluid in said buoyancy portion.

Ideally there should be no flow of fluid to or from the outside, therefore ensuring the overall buoyancy of the elongate subsea structure remains substantially constant before, throughout and after the fluid interchange.

Said elongate portion may comprise one or more rigid riser conduits. In a preferred embodiment said elongate portion further comprises a hollow central core. The fluid contained in said elongate portion may be stored in said central core only, in one or more of the risers only or in the central core and one or more of the risers.

Said buoyancy portion may be attached to said central core and support the weight of said at least one rigid riser conduit, said rigid riser conduit being free to move in relation to said central core. Said fluids may be allowed to interchange at a point just prior to the rigid riser conduit beginning to move in relation to the central core while the subsea structure is being tilted.

Said central core may have at least one buoyancy module attached thereto. There may be a plurality of buoyancy modules attached along the length of the core. The buoyancy modules may comprises syntactic foam and may be mechanically locked to the core by means of arrestors mounted or welded on the core pipe Tilting may be stopped to allow the fluids to interchange. Alternatively the fluid interchange may be allowed to happen as the tilting takes place. The fluids may also be allowed to interchange only after tilting has been completed and when said elongate subsea structure is in the vertical configuration.

Said buoyancy portion may be a buoyancy tank.

Said first fluid may be a gas such as compressed nitrogen and said second fluid may be a liquid such as water.

The buoyancy portion may be connected to said elongate portion by means of at least one transfer conduit, said transfer conduit allowing fluids to pass therebetween. Preferably said at least one transfer conduit has a valve to control flow. In one embodiment there are two transfer conduits, each permitting flow in a single, opposing, direction and each having its own valve. Said method may include the step of opening the valves at a non horizontal configuration and allowing said first and second fluids to interchange as a result of their relative densities. Alternatively, pumping means may be used. Said valves and/or pumping means may be controlled remotely, either directly from the surface or by an underwater vehicle such as an ROV.

In a further aspect of the invention there is provided a elongate subsea structure comprising an elongate portion and a buoyancy portion such that, when in a vertical installed configuration, the elongate subsea structure extends from the seabed towards the surface with said buoyancy portion attached to the top end of said elongate portion, and wherein there is provided means for interchanging the contents of said elongate portion and said buoyancy portion during installation of said elongate subsea structure.

Said elongate portion may comprise one or more rigid riser conduits. In a preferred embodiment said elongate portion further comprises a hollow central core. Said elongate subsea structure may comprise a plurality of risers arranged around said central core.

Said buoyancy portion may be attached to said central core and support the weight of said at least one rigid riser conduit, said rigid riser conduit being free to move in relation to said central core. Said means for interchanging may be arranged to allow the interchanging of the contents of said central core and said buoyancy tank at a point just prior to the conduit beginning to move in relation to the central core as a result of the elongate subsea structure being tilted from a horizontal configuration to a vertical configuration.

Said central core may have at least one buoyancy module attached thereto. Preferably there are a plurality of buoyancy modules attached along the length of the core. The buoyancy modules may comprises syntactic foam and may be mechanically locked to the core by means of arrestors mounted or welded on the core pipe Said means for interchanging may comprise at least one transfer conduit allowing fluids to pass therebetween. Preferably said at least one transfer conduit further comprises a valve to control flow. In one embodiment there are two transfer conduits, each permitting flow in a single, opposing, direction, each having its own valve. Although it is envisaged that the fluids will interchange as a result of their relative densities, there may be further provided pumping means to pump the fluids to speed up this interchanging of fluids, Said elongate subsea structure may have a taper joint connecting said elongate portion and said buoyancy portion.

BRIEF DESCRIPTION OF THE DRAWINGS

Embodiments of the invention will now be described, by way of example only, by reference to the accompanying drawings, in which:

FIG. 3*a*-3*d* shows a riser according to an embodiment of the invention in different stages of installation.

DETAILED DESCRIPTION OF THE EMBODIMENTS

Figure 1:
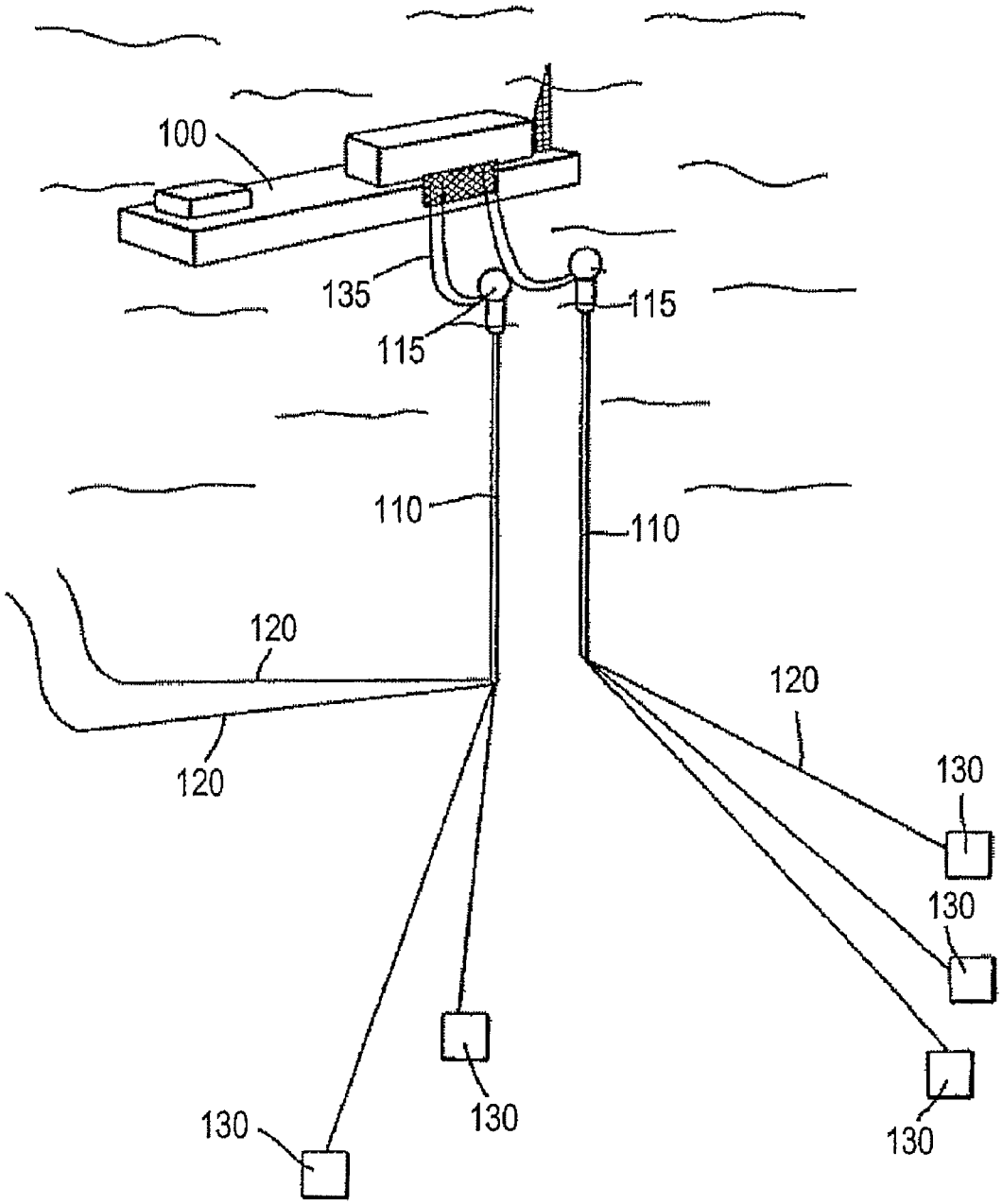
FIG. 1 shows a known type of riser structure in an offshore oil production system.

FIG. 1 illustrates a floating offshore structure 100 fed by riser bundles 110, which are supported by subsea buoys 115. Spurs 120 extend from the bottom of the riser bundle to the various well heads 130. The floating structure is kept in place by mooring lines (not shown), attached to anchors (not shown) on the seabed. The example shown is of a type known generally from the Girassol development, mentioned in the introduction above.

Each riser bundle is supported by the upward force provided by its associated buoy 115. Flexible jumpers 135 are then used between the buoys and the floating structure 100. The tension in the riser bundles is a result of the net effect of the buoyancy combined with the ultimate weight of the structure and risers in the seawater. The skilled person will appreciate that the bundle may be a few metres in diameter, but is a very slender structure in view of its length height) of for example 500 m, or even 1 km or more. The structure must be protected from excessive bending and the tension in the bundle is of assistance in this regard.

Figure 2:
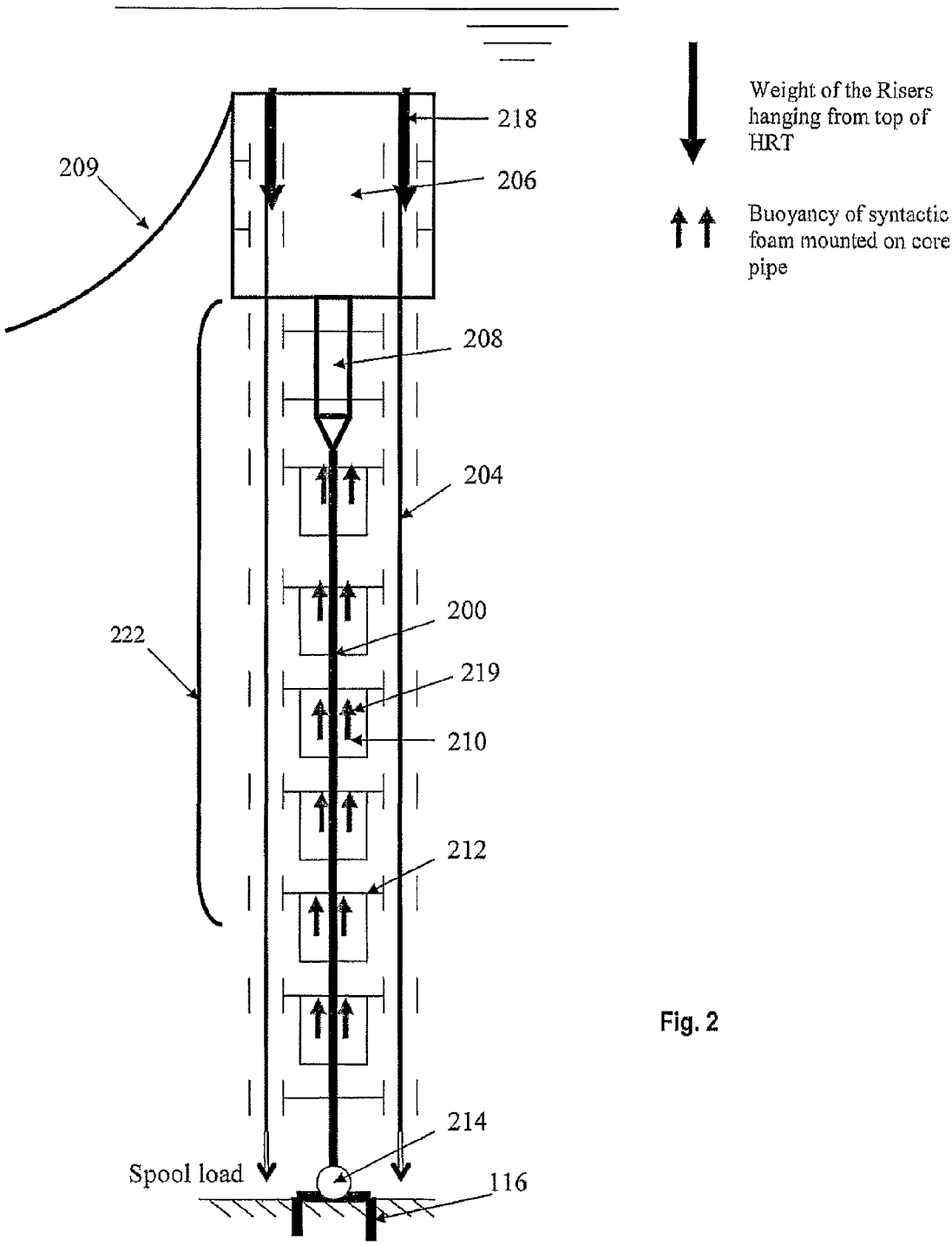
FIG. 2 shows the typical forces present on a riser structure when in a vertical configuration.

FIG. 2 shows the typical forces acting on a core pipe 200 of a riser tower 202 after up-ending from a horizontal (towed) configuration to a vertical (operational) configuration, once the riser has been towed to its instillation site.

The riser tower 202 comprises a riser 204 hanging from a buoyancy tank 206 to which it is attached at its top end, via taper joint 208. Flexibles 209 hang between the buoyancy tank 206 and surface vessel/platform. Running through the riser 204 is core pipe 200, these being arranged such that the riser 204 is free to slide in relation to the core pipe 200. Attached to the core pipe 200 at various points along its length is syntactic buoyancy foam 220, mechanically locked by means of arrestors mounted or welded on the core pipe thus preventing the foam from sliding upwards. This substantial quantity of syntactic foam is integrated to make the riser tower 202 nearly neutrally buoyant in water and so to facilitate the towing operation from its fabrication site to the installation site. It is also normal for the buoyancy tank 206 to be partially flooded during towing for the same reason. The drawing also shows the guiding frame and arrestor 212, flexible joint 214 and anchor 216.

The arrows represent the forces acting on the core pipe 200. The large downward arrows 218 represent the weight of the riser 204 hanging from the top of the riser tower 202. The smaller upward arrows 219 represent the buoyancy force of syntactic foam mounted to the core pipe. As a result of these opposing forces due to effect of riser weight and the buoyancy of syntactic foam a portion 222 of the core pipe 202 is subject to substantial and undesirable compressive forces.

Figure 3D:
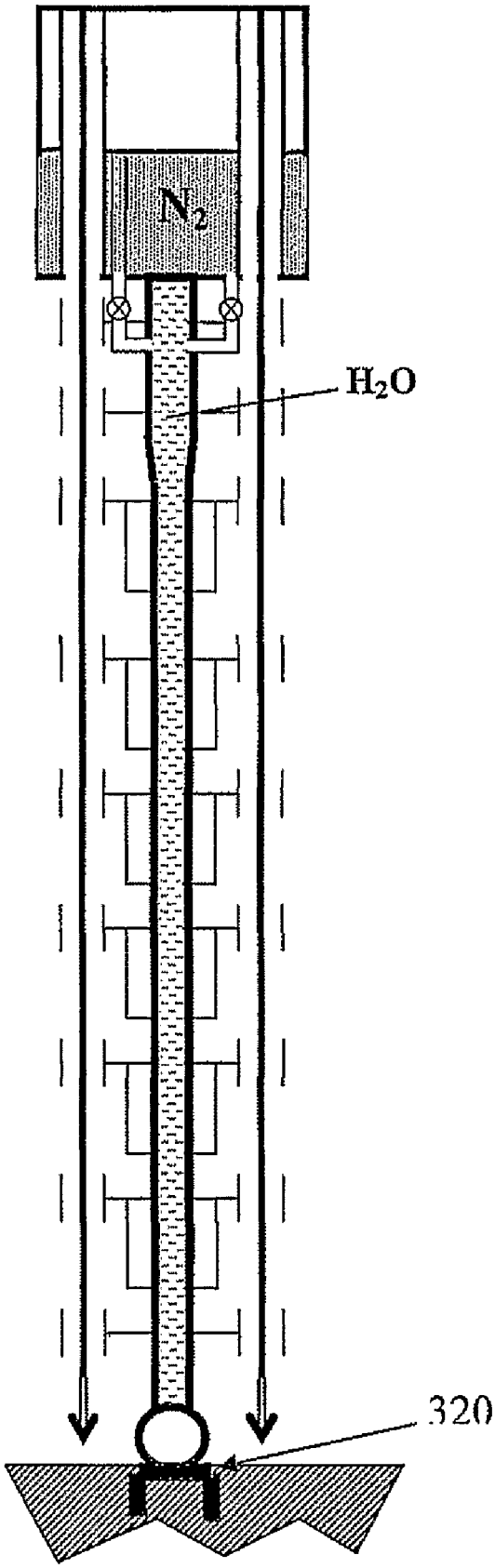

FIG. 3*a*-3*d* shows a riser tower bundle 300 which is designed to reduce or eliminate the compressive loads. In FIG. 3*a* the riser tower 300 is shown in its horizontal configuration for towing to the installation site. The riser tower 300 is similar to riser tower 202 of FIG. 2. It differs in that the core pipe is filled with pressurized nitrogen and that the buoyancy tank 302 compartment and the inside of the core pipe 304 are connected by transfer pipes 306 and an isolation valve arrangement 308, thus allowing fluids to be transferred between them.

In its horizontal configuration the buoyancy of the foam and the nitrogen, and the weight of the piping and water ballast nearly balance each other. This near neutral buoyancy of the riser tower as a whole facilitates the towing operation.

FIGS. 3*b* and 3*c* shows the riser tower 300 both before and after transference of the fluids contained therein. The riser tower 300 is in the process of being tilted from horizontal to a vertical angle at the installation site. At a point just before the riser 204 starts to slide and apply compression loads on the core pipe 204 the valves 308 in the piping system 306 are opened, either via remote control or by a Remotely Operated Vehicle (ROV). If the latter the controls or the valves themselves may be adapted to be easily manipulated by the ROV. The opening of the valves ensures that the liquid and gas transfer between the tank and the core pipe due to the weight of the water and relative densities of the two fluids (This transfer is represented by the two arrows 310 on FIG. 3*b*). This results in a significant reduction of the compression load induced in the core pipe this reduction being equivalent to the value of the weight of liquid transferred from the tank compartment to the core pipe. At the same time the global buoyancy balance of the riser tower structure in terms of the vertical load is unaffected. Also the water ballast in the buoyancy tank is emptied quicker than by conventional methods.

When upending operation is completed the riser tower 300 is fitted on its anchor base. FIG. 3*d* shows the riser tower 300 in its vertical configuration anchored to the seabed. The core pipe 304 is filled with water and the buoyancy tank 302 filled with nitrogen. The liquid transferred into the core pipe also allows for the reduction of the size of the HRT anchor base 320 embedded in the seabed.

It is also envisaged not only to have the central core initially filled with nitrogen but to also have the risers filled with nitrogen also, and for both the central core and riser to transfer their contents with the water in the buoyancy tank. Also envisaged is to have only the risers filled and for them alone to transfer their contents with the water in the buoyancy. While it is the fluid interchange between the buoyancy tank and the central core which results in the reduction of the compression forces on the subsea structure, having fluids exchange between the risers and the buoyancy tank also has advantages. The riser also needs to be flooded at some stage and this would speed up the flooding and dewatering processes as well as transporting the flooding liquid and dewatering gas directly in the structure.

The embodiments mentioned above are for illustrative purposes only and other embodiments and variations can be envisaged with departing from the spirit and scope of the invention.

The invention claimed is:

1. A method of installing an elongate subsea structure, said elongate subsea structure comprising an elongate portion and a buoyancy portion attached at one end of said elongate portion such that, when in a vertical installed configuration, the elongate subsea structure extends substantially from the seabed towards the surface with said buoyancy portion uppermost, and wherein said method comprises taking the elongate subsea structure to an installation site in a substantially horizontal configuration with said elongate portion containing a first fluid and said buoyancy portion containing a second fluid, said second fluid being more dense than said first fluid, and tilting the elongate subsea structure such that it takes a substantially vertical configuration by allowing said first fluid in said elongate portion to interchange with said second fluid in said buoyancy portion.

2. Method according to claim 1 wherein there is no flow of fluid to or from the outside of said elongate portion or said buoyancy portion.

3. Method according to claim 1 wherein said elongate portion comprises one or more rigid riser conduits.

4. Method according to claim 3 wherein said elongate portion further comprises a hollow central core.

5. Method according to claim 4 wherein the fluid contained in said elongate portion is stored in said central core only.

6. Method according to claim 4 wherein the first fluid or the second fluid, when contained in said elongate portion, is stored in one or more of the risers only.

7. Method according to claim 4 wherein the first fluid or the second fluid, when contained in said elongate portion, is stored in the central core and one or more of the risers.

8. Method according to claim 4 wherein said buoyancy portion is attached to said central core and supports the weight of at least one of said rigid riser conduit, said rigid riser conduit being free to move in relation to said central core.

9. Method according to claim 8 wherein said first fluid is allowed to interchange with said second fluid at a point just prior to the rigid riser conduit beginning to move in relation to the central core while the subsea structure is being tilted.

10. Method according to claim 4 wherein said central core has at least one buoyancy module attached thereto.

11. Method according to claim 10 wherein there is a plurality of buoyancy modules attached along the length of the core.

12. Method according to claim 11 wherein at least one of said buoyancy modules comprises syntactic foam.

13. Method according to claim 11 wherein at least one of said buoyancy modules is mechanically locked to the core by means of arrestors mounted or welded on the core pipe.

14. Method according to claim 1 wherein tilting is stopped to allow the fluids to interchange.

15. Method according to claim 1 wherein the fluid interchange is allowed to happen as the tilting takes place.

16. Method according to claim 1 wherein the fluids are allowed to interchange only after tilting has been completed and when said elongate subsea structure is in the vertical configuration.

17. Method according to claim 1 wherein said buoyancy portion is a buoyancy tank.

18. Method according to claim 1 wherein said first fluid is a gas and said second fluid is a liquid.

19. Method according to claim 18 wherein said gas is compressed nitrogen and said liquid is water.

20. Method according to claim 1 wherein said buoyancy portion is connected to said elongate portion by means of at least one transfer conduit, said transfer conduit allowing fluids to pass therebetween.

21. Method according to claim 20 wherein said at least one transfer conduit has a valve to control flow.

22. Method according to claim 21 wherein there are two transfer conduits, each permitting flow in a single, opposing, direction and each having its own valve.

23. Method according to claim 22 wherein said method includes the step of opening at least one of said valves at a non horizontal configuration and allowing said first and second fluids to interchange as a result of their relative densities.

24. Method according to claim 22 wherein at least one of said valves is controlled remotely, either directly from the surface or by an underwater vehicle.

25. Method according to claim 1 wherein pumping means are used to interchange said first and second fluids.

26. Method according to claim 25 wherein said pumping means is controlled remotely, either directly from the surface or by an underwater vehicle.

27. An elongate subsea structure comprising:

an elongate portion, said elongate portion containing a first fluid, and a buoyancy portion, said buoyancy portion containing a second fluid, said second fluid being more dense than said first fluid, such that, when in a vertical installed configuration, the elongate subsea structure extends from the seabed towards the surface with said buoyancy portion attached to the top end of said elongate portion, and wherein said first fluid and said second fluid are interchanged between said elongate portion and said buoyancy portion during installation of said elongate subsea structure and tilt the elongate subsea structure such that it takes a substantially vertical configuration.

28. Elongate subsea structure as claimed in claim 27 wherein said elongate portion comprises one or more rigid riser conduits.

29. Elongate subsea structure as claimed in claim 28 wherein said elongate portion further comprises a hollow central core.

30. Elongate subsea structure as claimed in claim 29 wherein said elongate portion comprises a plurality of risers arranged around said central core.

31. Elongate subsea structure as claimed in claim 29 wherein said buoyancy portion is attached to said central core and supports the weight of said at least one rigid riser conduit, said rigid riser conduit being free to move in relation to said central core.

32. Elongate subsea structure as claimed in claim 31 wherein said means for interchanging is arranged to allow the interchanging of the contents of said central core and said buoyancy portion at a point just prior to the conduit beginning to move in relation to the central core as a result of the elongate subsea structure being tilted from a horizontal configuration to a vertical configuration.

33. Elongate subsea structure as claimed in claims 29 wherein said central core has at least one buoyancy module attached thereto.

34. Elongate subsea structure according to claim 33 wherein there is a plurality of buoyancy modules attached along the length of the core.

35. Elongate subsea structure according to claim 33 wherein at least one said buoyancy modules comprises syntactic foam.

36. Elongate subsea structure according to claim 33 wherein at least one said buoyancy module is mechanically locked to the core by means of arrestors mounted or welded on the core pipe.

37. Elongate subsea structure according to any of claims 27 wherein said buoyancy portion is connected to said elongate portion by means of at least one transfer conduit, said transfer conduit allowing fluids to pass therebetween.

38. Elongate subsea structure according to claim 37 wherein said at least one transfer conduit has a valve to control flow.

39. Elongate subsea structure according to claim 38 wherein there are two transfer conduits, each permitting flow in a single, opposing, direction and each having its own valve.

40. Elongate subsea structure according to claim 39 wherein at least one of said valves is provided with means for being controlled remotely.

41. Elongate subsea structure according to claim 39 wherein at least one of said valves is adapted to be controlled by an underwater vehicle.

42. Elongate subsea structure according to claims 27 to wherein pumping means are used to interchange said first and second fluids.

43. Elongate subsea structure according to claim 42 wherein said pumping means is provided with means for being controlled remotely.

44. Elongate subsea structure according to claim 42 wherein said pumping means is adapted to be controlled by an underwater vehicle.

45. Elongate subsea structure according to claim 27 further comprising a taper joint connecting said elongate portion and said buoyancy portion.

* * * * *